US006856785B1

(12) United States Patent
Schwenk et al.

(10) Patent No.: US 6,856,785 B1
(45) Date of Patent: Feb. 15, 2005

(54) RETRACTABLE REGISTRATION SYSTEM AND METHOD OF USE

(75) Inventors: Alicia K. Schwenk, Penfield, NY (US); Richard J. Milillo, Fairport, NY (US); Brian J. Dunham, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/740,477

(22) Filed: Dec. 22, 2003

(51) Int. Cl.[7] ..... G03G 15/00
(52) U.S. Cl. ..... 399/395; 400/579; 271/243
(58) Field of Search ..... 399/388, 394, 399/395, 397; 400/579; 271/226, 243

(56) References Cited

U.S. PATENT DOCUMENTS 4,743,129 A * 5/1988 Keryhuel et al. ..... 400/582
4,861,012 A * 8/1989 Shimizu ..... 271/3.02
5,524,994 A * 6/1996 Hirano et al. ..... 400/579
5,997,197 A * 12/1999 Trovinger et al. ..... 400/579
6,079,887 A * 6/2000 Koyabu et al. ..... 400/579
6,168,153 B1 * 1/2001 Richards et al. ..... 271/227
6,494,451 B2 * 12/2002 Michel ..... 271/274

OTHER PUBLICATIONS

U.S. Appl. No. 10/604,013, filed Jun. 2003, Milillo et al.

* cited by examiner

*Primary Examiner*—Ren Yan
(74) *Attorney, Agent, or Firm*—Oliff & Berridge, PLC

(57) ABSTRACT

A registration system including both a primary tamping device and a secondary scuffing device. The scuffing device includes a scuffer arm, an extending/retracting device, a drive subsystem, and an engagement control device. In various exemplary embodiments, the secondary scuffing device is retracted. The scuffing device can thus be used, when required, to register a substrate in the process direction and then retracted enabling the side tampers to cross process register the substrates. In various exemplary embodiments, substrates of varying sizes and types can be registered into common sets using the systems and methods of this invention.

20 Claims, 7 Drawing Sheets

FIG. 6
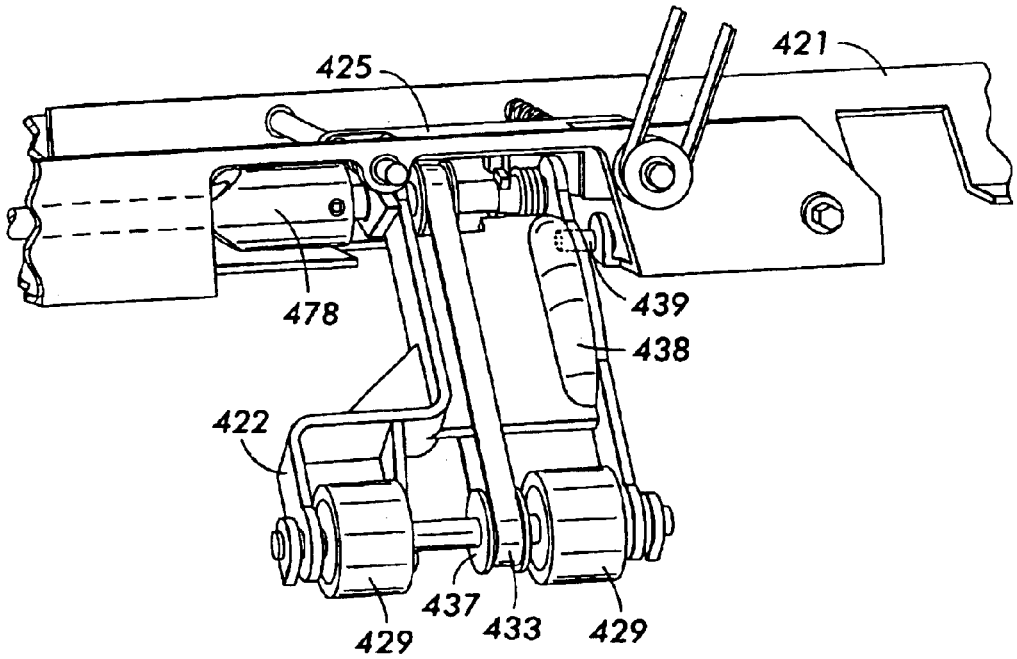
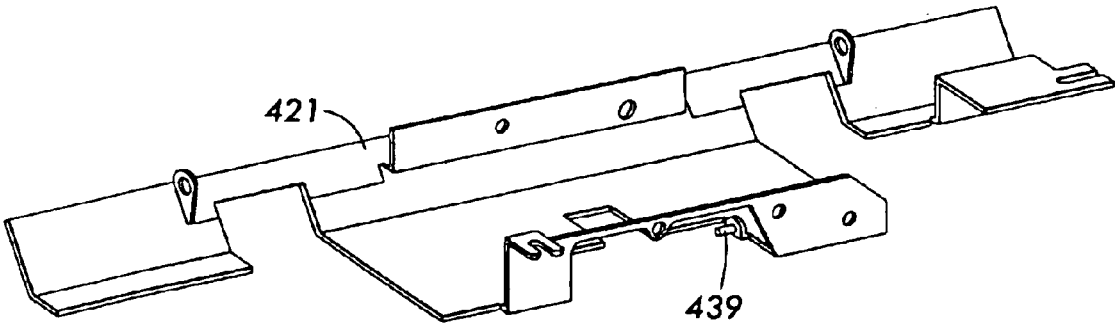
FIG. 7

RETRACTABLE REGISTRATION SYSTEM AND METHOD OF USE

BACKGROUND OF THE INVENTION

1. Field of Invention

This invention is directed to systems and methods for registering substrates.

2. Description of Related Art

An important element of an image forming system is the ability to handle large print jobs while maintaining high speed and efficiency. Critical to this capability is proper alignment, or registration, of the substrates, such as for example copy sheets, as the substrates are transported through various image forming and sheet processing functions. Proper registration ensures accurate and high quality during the image forming and sheet processing process. Further, imaging-forming systems may utilize primary and secondary registration systems during the image forming process to keep substrates properly aligned. For example, substrates could be initially registered prior to image transfer and later during the compilation process.

In many imaging-forming systems that have handling and compiling systems, such as, for example, printer copiers and the like, trays are often used to compile the sheets, either individually or in stacks. As is well known in the handling and compiling art, tamping systems are commonly utilized to register the sheets in compiler trays. Walls or tamper arms on the sides of the tray can be moved repeatedly and reversibly against one or more sides of an incoming sheet or sets of sheets, thereby achieving proper alignment and square stacking. Once squared, sheet stacks are more accurately manipulated, such as, for example, by stapling or hole-punching, during the finishing stages of the image forming process.

Another important element in imaging-forming systems is the capability of handling a variety of substrates. In most conventional systems used for printers, copiers, and facsimile machines, the types of substrates being transported usually do not vary much. Most systems typically encounter only a limited number of different substrate types, such as, for example, A4 or 8.5"×11" papers.

SUMMARY OF THE INVENTION

However, the primary registration system often used in many set compiler subsystems cannot be used for certain sheet types or when two or more sheet sizes are used in combination. Further, the ability to use a secondary registration system in combination with the primary registration system is often limited by the paper path architecture and space constraints, which often requires that the secondary registration system get out of the way of the incoming paper between sheets and/or between sets. Subsequently, the paper path is often designed in a way that only a stationary registration system can be used. In addition, using a secondary registration system only when needed can help to reduce it's wear, extend it's replacement life and/or allow its design to be made more economical and/or less robust. Also, using a secondary registration device only when needed, when such a secondary device is a friction type device, can help reduce marking and/or smearing of the substrates when it is not used, especially for those substrates that are prone to marking and/or smearing.

This invention provides a registration system approach that helps minimize the footprint and help maximize the efficiency of space used in finishing devices, especially in high volume type finishing applications which may or may not have multiple discharge paths.

This invention separately provides systems and methods for registering sheets with tampers and a scuffer.

In various exemplary embodiments of the system and methods according to this invention, substrates can be registered using a combination of scuffing and tamping, scuffing only, and/or tamping only. For example, substrates can be first scuffed and then tamped, or vice versa.

In various exemplary embodiments, the registration system according to this invention includes both a primary tamping device and a secondary scuffing device. In various exemplary embodiments of the systems and methods according to this invention, the secondary scuffing device can be retracted. For example, the scuffing device can be used to register a substrate in the process direction and then retracted enabling the side tampers to cross-process-register the substrates.

In various exemplary embodiments of the systems and methods according to this invention, substrates of varying sizes and types can be registered into common sets using the systems and methods of this invention.

These and other features and advantages of this invention are described, or are apparent from, the following detailed descriptions of various exemplary embodiments of the systems and methods according to this invention.

BRIEF DESCRIPTION OF THE DRAWINGS

Various exemplary embodiments of the invention will be described in detail with reference to the following figures, wherein:

FIG. 6 is a front perspective view showing in greater detail the first exemplary embodiment of the scuffer arm and support frame of the first exemplary embodiment of the retractable scuffer registration device according to this invention;

FIG. 7 is a bottom perspective view showing in greater detail the first exemplary embodiment of the scuffer arm and support frame of the first exemplary embodiment of the registration device according to this invention;

DETAILED DESCRIPTION OF EXEMPLARY EMBODIMENTS

The various exemplary embodiments of the systems and methods according to this invention enable the registration of substrates in an imaging-forming system to be advanced through the use of a registration system. The mechanisms and techniques used in the registration system according to this invention provide a combination of scuffing and tamping.

The following detailed description of various exemplary embodiments of the substrate registration systems and methods according to this invention may refer to one specific type of substrate, copy sheets, for the sake of clarity and familiarity. Further, for the sake of clarity and familiarity, this invention may refer to one specific type of imaging-forming device, a copier or printer. However, it should be appreciated that the principles of this invention, as outlined and/or discussed below, can be equally applied to any known or later-developed substrate and/or imaging-forming device, or any other sheet-like substrate handling device, beyond any copy sheets and copiers specifically discussed herein.

Figure 1:
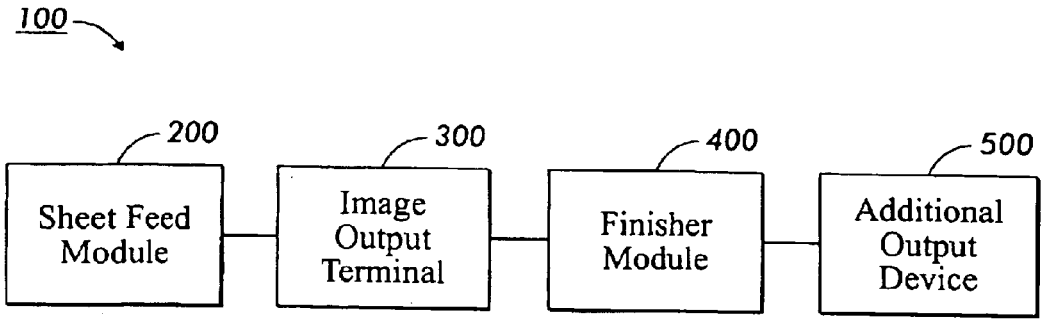
FIG. 1 is a block diagram of one exemplary embodiment of an imaging-forming system usable with various exemplary embodiments of the systems and methods according to this invention.

FIG. 1 is a block diagram of one exemplary embodiment of an imaging-forming system 100 in which a sheet may need to be registered. As shown in FIG. 1, the image-forming system 100 includes a sheet feed module 200, an image output terminal 300 and a finisher module 400. In addition, the image forming system 100 includes an additional output device module 500 such as a finisher, stacker or other forms of output finishing and or sheet/set handling devices.

It should be appreciated that the sheet feed module 200, the image output terminal 300 and the finisher module 400, while depicted separately in FIG. 1, are not necessarily separate and distinct components. The functions and/or operations of any one or more of these elements may be carried out by a single device, structure, and/or system. Further, it should be appreciated that additional devices, structures and/or systems may be included in the imaging forming system 100, such as, for example, a sheet preparation module.

Figure 2:
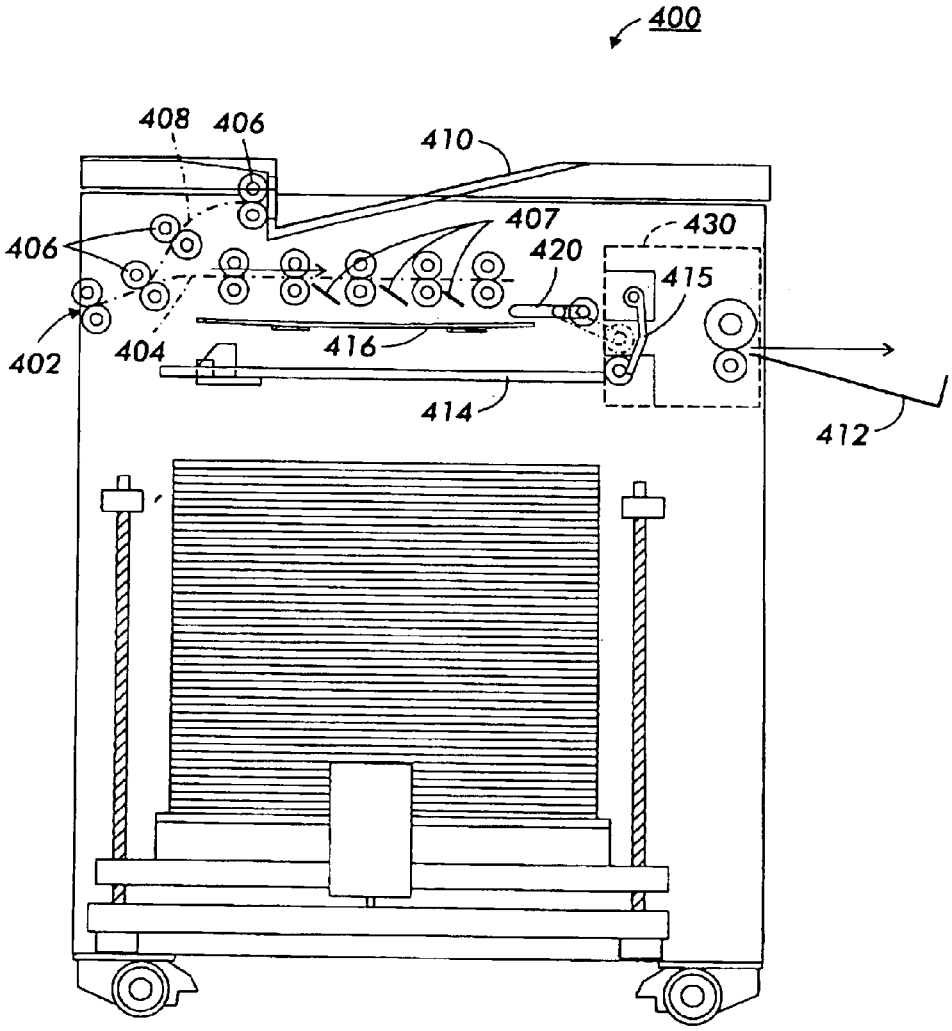
FIG. 2 is a block diagram of one exemplary embodiment of a finisher module.

FIG. 2 illustrates one exemplary embodiment of the finisher module 400. As shown in FIG. 2, the finisher module 400 includes a sheet receiving inlet 402, a main transport path 404, a bypass path 408, a top bypass tray 410, an optional temporary compiler or sheet buffering station 416, a compiling platform 414, retractable scuffing system 420, a manipulation device 430, sheet lead edge registration gates 415 and a discharge outlet 412. A number of pairs of transport nip rollers 406 move the sheets along the main transport path 404.

It should be appreciated that the manipulation device 430 can be any device capable of manipulating a sheet or a set of sheets, including, but not limited to, stapling, punching, stitching, perforating and/or the like. It should be appreciated that the manipulation device 430 may or may not be included in the finisher module 400 and that the location and/or capability of the manipulation device 430 is a design choice and will be obvious to those skilled in the art.

In operation, sheets are received from the image output terminal 300 through the sheet receiving inlet 402. Sheets are transported along the main transport path 404 by the one or more pairs of transport nip rollers 406. Sheets not compiled into sets can be diverted to the top bypass tray 410 along the bypass path 408. Otherwise, sheets are transported along the main transport path 404 and are diverted to the compiler platform 414 by an appropriate one of a number of gates 407 that divert the sheets to the compiling platform 414. In various exemplary embodiments for each sheet, the appropriate gate 407 is selected based on a length of that sheet.

Sheets to be compiled are received by the compiling platform 414. As each sheet is received, the compiling platform 414 registers the sheet laterally and/or along the process direction by using a scuffing system 420 (shown in FIGS. 3–4 and 6–9) and/or one or more tamping devices and lead edge registration gates 415, which are made capable of pivoting and or moving out of the way of the paper to enable the discharge outlet 412. The compiling platform 414 continues to receive sheets and to register the sheets until the desired number of sheets in a set are received. The compiled and registered set can be manipulated by the manipulation device 430. Whether manipulated or not, the compiled and registered set of sheets is then output from the finisher module 400 through the discharge outlet 412 or, alternatively, can be dropped to a stacking device positioned below the compiling platform 414. The compiling platform 414 is then ready to receive the next set of sheets. An optional temporary compiler or bufferring station 416 can be employed to catch and hold one or more of the first sheets of the next set in order to allow the first set to be processed and discharged. This bufferring operation can be used to improve productivity of the device by eliminating longer time gaps between the last and first sheets of adjacent sets. This process is continued until the desired number of sets is compiled, registered and, optionally, manipulated.

Registering sheets is accomplished by utilizing the lead edge registration gates 415 and tamping and/or scuffing each sheet as it moves onto the compiling platform 414. In various exemplary embodiments, as disclosed in a co-pending U.S. patent application Ser. No. 10/604,013, incorporated herein by reference, one or more of the one or more tamping devices used to register the sheets can be integrated into the compiling platform 414.

Figure 3:
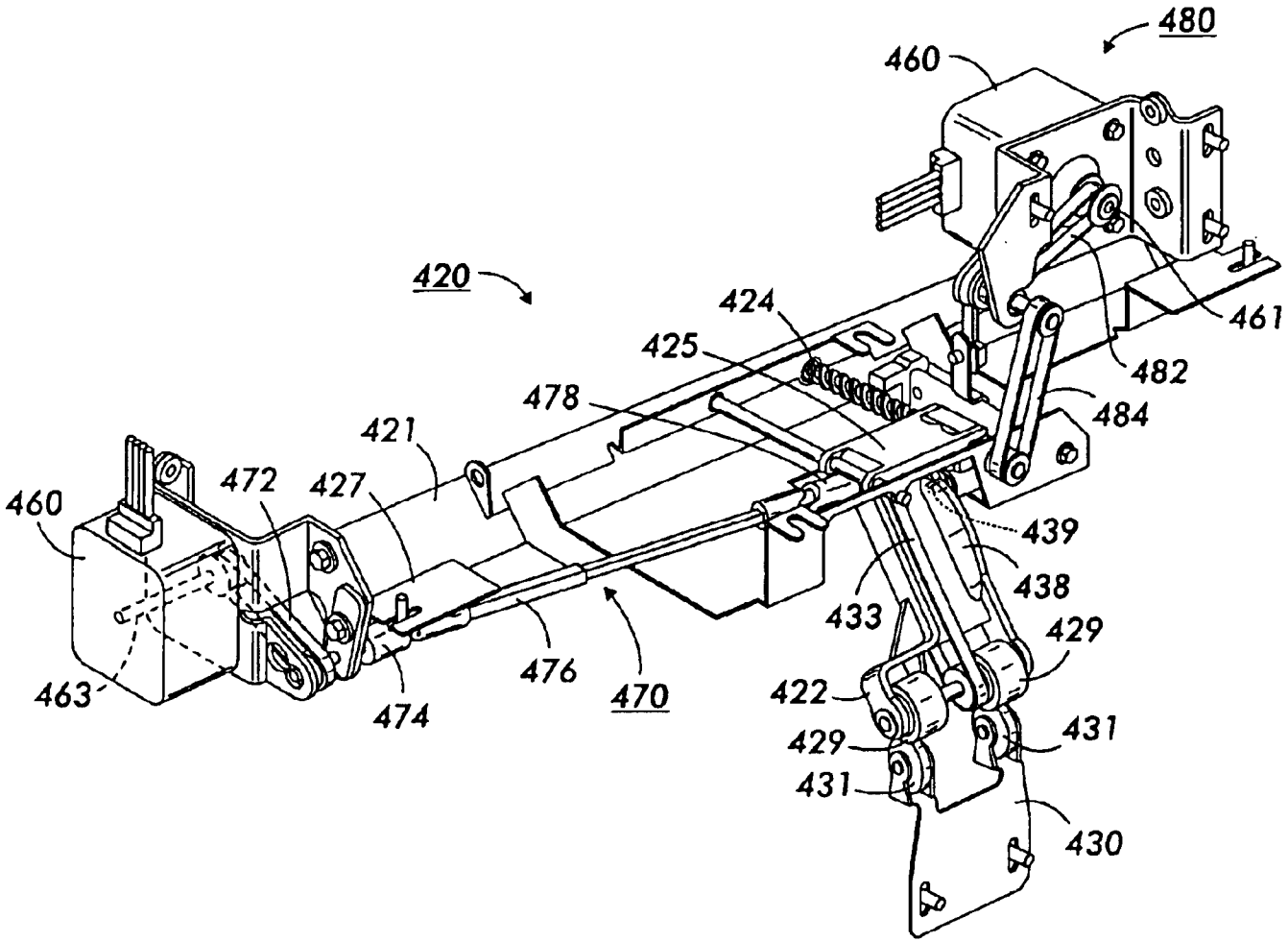
FIG. 3 shows in greater detail a first exemplary embodiment of a retractable scuffer registration device according to this invention, where the retractable scuffer registration device has been extended.
Figure 4:
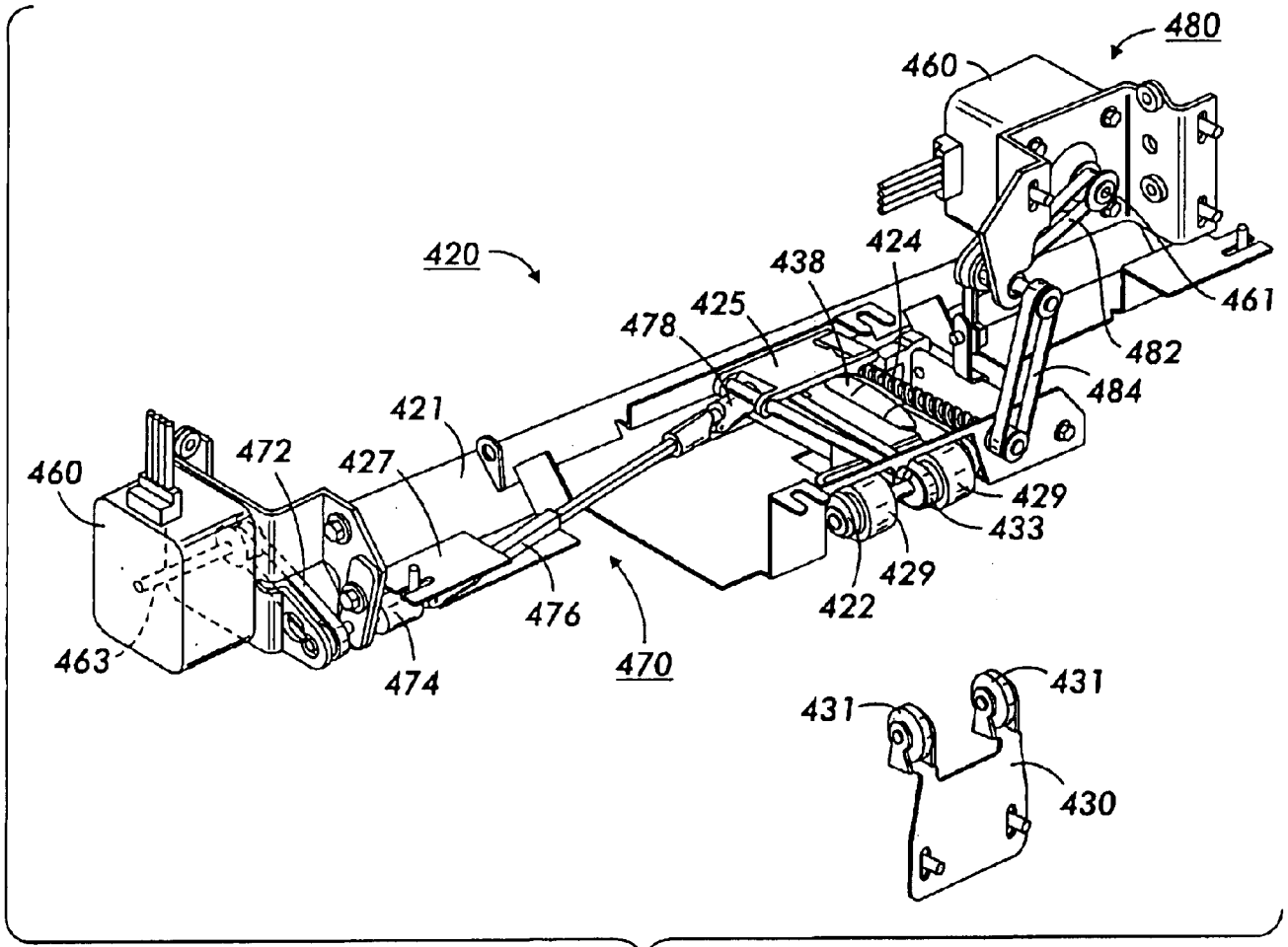
FIG. 4 shows in greater detail the first exemplary embodiment of the retractable scuffer registration device according to this invention, where the retractable scuffer registration device has been retracted.

FIG. 3 shows in greater detail one exemplary embodiment of the scuffing system 420. As shown in FIG. 3, the scuffing system 420 includes a support frame 421, a scuffer arm 422, a lead screw 424 and a threaded slide 425 connected to the scuffer arm 422. One or more friction wheels 429 are attached to the scuffer arm 422. In FIG. 3, the scuffer arm 422 is in the extended position, where the one or more friction wheels 429 are placed opposite a similar number of idler wheels 431 or a platform (not shown) of a fixed assembly 430. FIG. 4 shows the exemplary embodiment of the scuffer system 420 of FIG. 3 with the scuffer arm 422 in a retracted position.

As shown in FIG. 3, the scuffer arm 422 also includes a drive belt 433 connected to the friction wheels 429. The scuffing system 420 also includes a drive system 460 comprising a pair of drive motors 461 and 463, and a first drive transfer system 480 comprising a first drive belt 482 and a second drive belt 484 that connects the first drive motor 461 to the lead screw 424. A second drive transfer system 470 includes a third belt 472, a pair of universal joints 474 and 478 and a shaft 476 to connect the second drive motor 463 to the belt 433.

As shown in FIG. 3, the scuffing system 420 utilizes the lead screw 424 and the threaded slide 425 to lower the scuffer arm 422 into a scuffing position. In particular, the first motor 461 of the drive system 460 is operated in an extension direction to rotate the belts 482 and 484 of the first drive transfer system 480. The motor 461 of the first drive transfer system 480, via a pulley, drives the belt 482 which, by a set of pulleys, is connected to and drives the belt 484, causing the belt 484 to rotate. The belt 484 is connected to the lead screw 424 by yet another pulley. The rotation of the belt 484 in the extension direction causes the lead screw 424 to rotate in the extension direction. As a result, the threaded slide 425, which is threaded onto the lead screw 424, moves to the extended position shown in FIG. 3 from the retracted position shown in FIG. 4. As depicted in FIG. 3, this in turn extends the scuffer arm 422 in a motion that brings the scuffer arm 422 and the friction wheels 429 towards, and ultimately into contact with, a top surface of a sheet to be scuffed.

Figure 5:
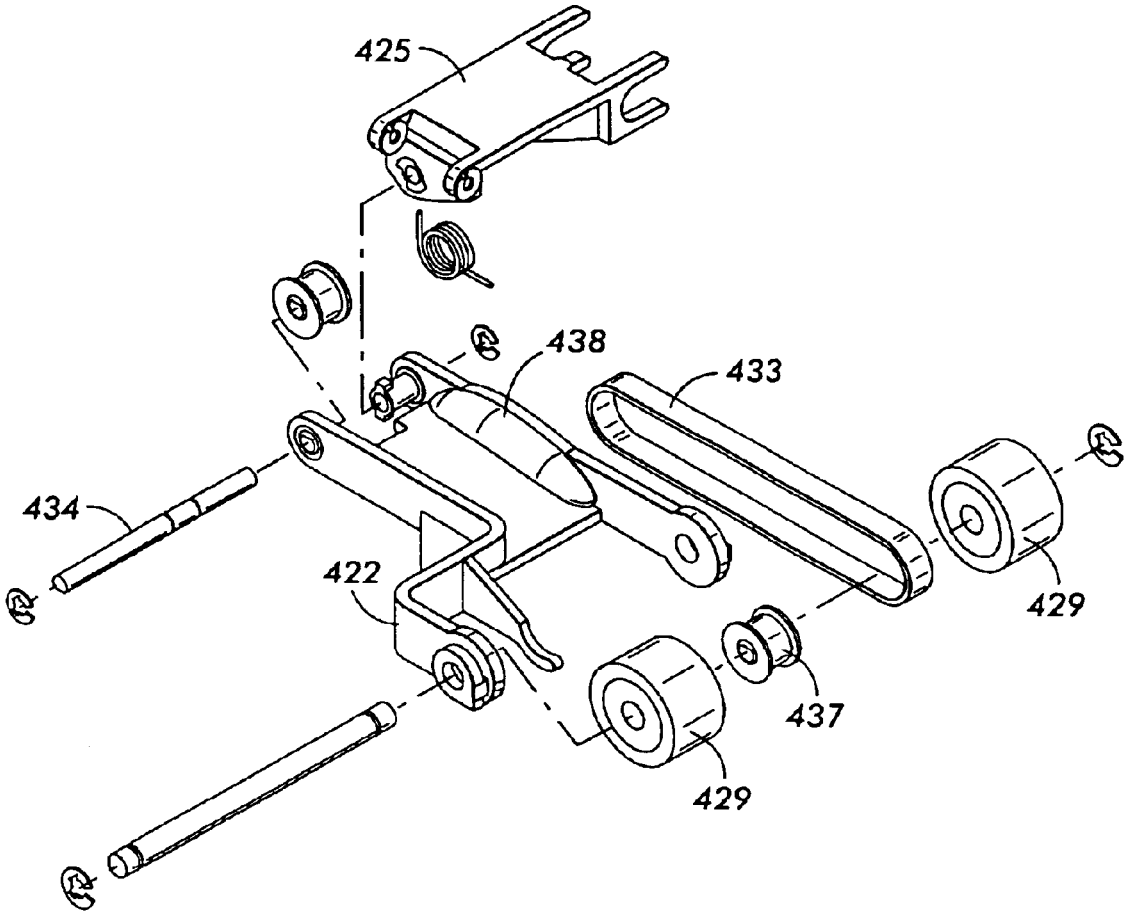
FIG. 5 is an exploded view showing in greater detail a first exemplary embodiment of the scuffer arm and threaded slide of the first exemplary embodiment of the retractable scuffer registration device according to this invention.

At the same time, or at some earlier or later time, that the first motor 461 of the drive subsystem 460 is operated in an extension direction, the second motor 463 of the drive system 460 operates to rotate the belt 433 and drive the friction wheels 429. The motor 463 drives the third belt 472, which is connected to the first universal joint 474. The first universal joint 474 is connected to the second universal joint 478 by the shaft 476, which is held in place by the guiding plate 427 of the support frame 421. The second universal joint 478 is in turn connected to a drive shaft 434 (shown in FIG. 5) of the scuffer arm 422.

As threaded slide 425 moves from an initial retracted position shown in FIG. 4 to the extended inclined position shown in FIG. 3, the scuffer arm 422 is supported and guided in the manner discussed below. One end portion of the scuffer arm 422 is pivotally connected to the threaded slide 425 via the drive shaft 434. When the threaded slide 425 moves between the extended position and the retracted position, the scuffer arm 422 pivots about the drive shaft 434.

As the scuffer arm 422 is extended, a sheet to be scuffed is caught between the friction wheels 429 and the idler wheels 431 or platform before the scuffer arm 422 becomes fully extended. The friction wheels 429 thus engage the sheet, and, driven by the second drive motor 463, the second drive transfer system 470 and the belt 433, push or scuff the sheet forward as the scuffer arm 422 becomes fully extended. Shortly after, or even as, the scuffer arm 422 reaches its fully extended position, the first drive motor 461 is driven in the opposite, or retraction, direction, to return the scuffer arm 422 to its fully retracted position shown in FIG. 4.

In particular, as the first drive motor 461 is operated to drive the first drive transfer system 480 in the opposite, or retraction, direction, the threaded slide 425 also slides along the lead screw 424 in the opposite, or retraction, direction. As the threaded slide 425 slides in the retraction direction, the scuffer arm 422 is pulled from the extended position to the retracted position.

Figure 8:
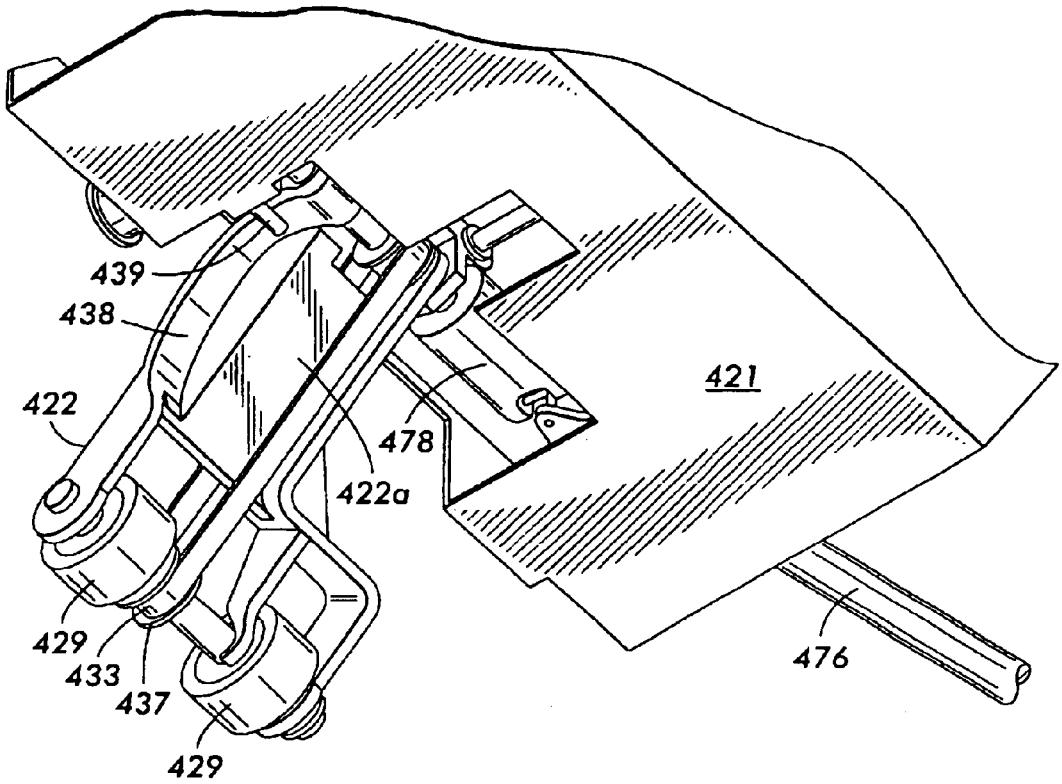
FIG. 8 shows in greater detail one exemplary embodiment of the support frame of the first exemplary embodiment of the retractable scuffer registration device according to this invention.

FIGS. 5–8 show the scuffer arm 422 and related portions of the support frame 421 and the second drive transfer system 470 in greater detail. As shown in FIGS. 3–8, the scuffer arm 422 also includes a cam portion 438, which controls the angle of orientation of the scuffer arm 422 as it is extended and retracted. As shown in FIGS. 5–8, the cam portion 438 is located on a surface of the scuffer arm 422 opposite the belt 433. The cam portion 438 includes a recessed, arched surface located on a bottom surface 422*a* of the scuffer arm 422, as shown in FIG. 8. As the threaded slide 425 moves between the extended position and the retracted position, the recessed arched portion of the cam portion 438 engages with a roller bearing 439, which as shown most clearly in FIG. 7, is attached to the support frame 421. Thus, arched surface of the recessed, arched cam portion 438 rolls past the roller bearing 439 to support and guide the scuffer arm 422 as it is being retracted to or extended from the support frame 421.

The roller bearing 439 supports and guides the cam portion 438 as the scuffer arm 422 is extended. The roller bearing 439 also supports and guides the cam portion 438 causing the scuffer arm 422 to rise away from the sheet that has just been scuffed, so that the sheet is not caught between the friction wheels 429 and the idler wheels 431 or platform and brought out of registration. In particular, the friction wheels 429 are rapidly vertically disengaged from the sheet before the scuffer arm 422 is translated horizontally. Because the friction wheels 429 are disengaged from the sheet, the sheet is not inadvertently withdrawn by the friction wheels 429 while the scuffer arm 422 is being withdrawn.

It should be appreciated that the shape and design of the first and second universal joints 474 and 478, the design of the scuffer arm 422, the contact speed and/or angle of the scuffer arm 422 relative to the sheet, and/or the design of the friction wheels 429 that ensure proper engagement with the sheet for registration are design choices that will be obvious and predicable to those skilled in the art. It should also be appreciated that any other known or later-developed mechanism can be used in place of the lead screw 424 and threaded slide 425 to extend/retract the scuffing arm 422. It should further be appreciated that any known or later-developed mechanism and the design of the cam portion 438 of the scuffer arm 422, the roller bearing 439 and the connection of the scuffer arm 422 to the threaded slide 425 can be used to support and guide the scuffer arm 422 from an initial retracted position to an inclined extended position.

In operation, a sheet is received by the compiling platform 414 via one of the gates 407. The scuffing system 420 extends the scuffer arm 422 to scuff the sheet forward to ensure the leading edge of the sheet is aligned with, or registered against the lead edge registration gates 415, or, optionally, a manipulation device 430 (if provided). The scuffer arm 422 may be raised and retracted, enabling the tampers to be engaged. In general, the scuffing system 420 operates as the sheet registration device in the process direction while the tampers are used for cross-process-direction registration. The process of alternatingly scuffing and tamping to register sheets enables the registration of sheet sets of different sizes. However, it should be appreciated that the combination of scuffing and tamping can be altered and combined in a manner that is suitable to the process desired.

In addition to scuffing the sheets to obtain lead edge registration, the scuffing system 420 can also be used to thump sheets and/or sheet sets. Thumping or bumping the set with some vertically directed force may be done to help compress the set being compiled. Thumping is accomplished through a vertical motion of the scuffer arm 422 onto the sheets. Further, the use of thumping can be combined with the scuffing and tamping registration process in a manner suitable to the process desired. In various exemplary embodiments, the scuffer system 420, utilizing it's up (retracted) and down (extended) motions and friction wheels 429, as required, can be used to intermittently thump the sheet or set of sheets.

The proper amount of pressure should be applied to the scuffer arm 422 against the sheet to avoid damaging the sheet, for example, by marking or crinkling the sheet. In various exemplary embodiments, maintaining the proper pressure by the scuffer arm 422 on the sheet as the sheet is being scuffed is accomplished by a combination of the design of the scuffer arm 422, including, for example, the design of the retraction extension mechanisms of the scuffing system 420, and the design of the compiling platform 414. For example, the compiling platform 414 may incorporate a depression plate that provides an upward pressure on the sheets that in turn presses up against the scuffer arm 422 while the scuffer arm 422 is in operation. It should be appreciated that the design of the scuffer system 420 and the compiling platform 414 is a design choice and will be obvious and predictable to those skilled in the art.

Figure 9:
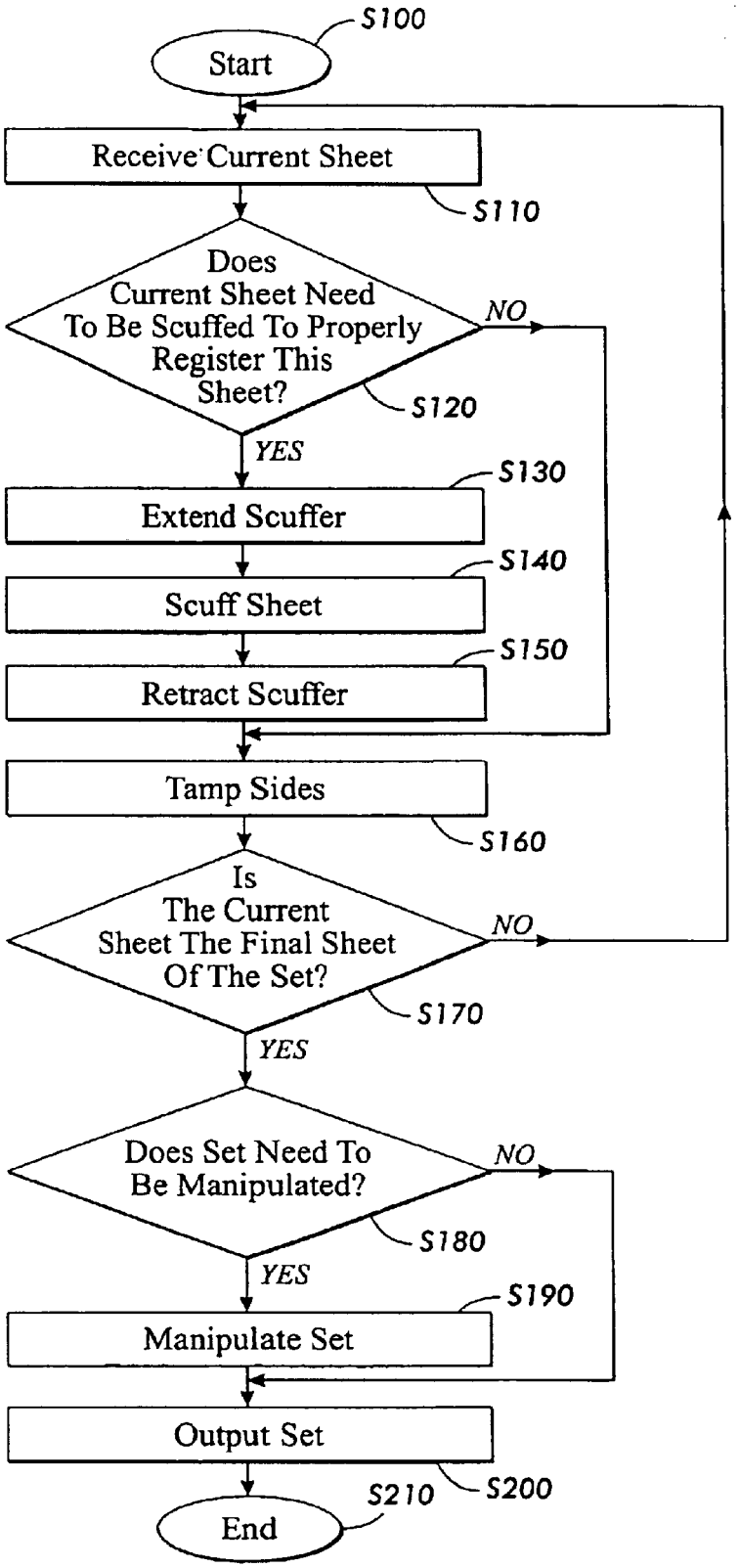
FIG. 9 is a flowchart outlining one exemplary embodiment of a method for registering a sheet using the registration system.

FIG. 9 is a flowchart outlining one exemplary embodiment of a method for registering a sheet according to this invention. Beginning in step S100, operation of the method continues to step S110, where a current sheet is received by the compiling platform 414. Then, in step S120, a determination is made whether the current sheet needs to be scuffed to properly register the current sheet. If the sheet does require scuffing, operation continues to step S130. Otherwise, operation jumps to step S160.

In step S130, the scuffer arm is extended and the friction wheels are driven. Next, in step S140, the sheet is scuffed forward by the friction wheels of the scuffer arm to register the lead edge of the current sheet. Then, in step S150, friction wheels of the scuffer arm is retracted to disengage the friction wheels from the sheet. Operation then continues to step S160.

In step S160, the scuffer arm is fully retracted. Then, in step S170, the sides of the sheet are tamped. Next, in step S180, a determination is made whether the sheet is the final sheet of a set. If the sheet is the last sheet of a set or is not in a set, operation continues to step S190. Otherwise, operation returns to step S110.

In step S190, a determination is made whether the sheet set requires manipulation. If the set requires manipulation, operation continues to step S200. Otherwise, operation jumps to step S210. In step S200, the set is manipulated. Next, in step S210, the set is output to a downstream processing module or operation, or is output to a stacker or other output tray or device. Then, in step S220, operation of the method ends.

While this invention has been described in conjunction with various exemplary embodiments, it is to be understood that many alternatives, modifications and variations would be apparent to those skilled in the art. Accordingly, the preferred embodiments of this invention, as set forth above are intended to be illustrative, and not limiting. Various changes can be made without departing from the spirit and scope of this invention.

What is claimed is:

1. A scuffing device, comprising:

a scuffer arm;

an extending/retracting device connected to the scuffer arm;

a drive subsystem connected to the extending/retracting device; and an engagement control device, wherein:

the drive subsystem drives the extending/retracting device between a first engaging position that allows the scuffer arm, when extended, to engage a surface to be scuffed and a second disengaging position that, when the scuffer arm is extended, disengages the scuffer arm from the surface to be scuffed;

when the drive subsystem drives the extending/retracting device in a first direction, the engagement control device controls a position of the scuffer arm relative to the surface to be scuffed as the extending/retracting device extends the scuffer arm from a first, retracted position to a second, extended position where the scuffer arm is able to engage the surface to be scuffed, and when the drive subsystem drives the extending/retracting device in a second direction, the engagement control device controls a position of the scuffer arm relative to the surface to be scuffed as the extending/retracting device retracts the scuffer arm from the second, extended position to the first, retracted position.

2. The scuffing device of claim 1, wherein the scuffer arm includes at least one friction wheel.

3. The scuffing device of claim 2, further comprising at least one idler wheel or platform, wherein, when the scuffer arm is placed in the second, extended position, the at least one friction wheel is positioned opposite the at least one idler wheel or platform to form a nip between at least one friction wheel and at least one guide wheel.

4. The scuffing device of claim 2, wherein the drive subsystem comprises:

a motor; and a drive transfer system that connects the motor to the at least one friction wheel such that rotation of the motor causes the friction wheel to rotate.

5. The scuffing device of claim 4, wherein:

the drive transfer system comprises:

a first belt/pulley subsystem;

a first joint connected to the first belt/pulley subsystem;

a second joint connected to a shaft; and a second belt/pulley subsystem connected to the shaft, wherein the second drive transfer system transmits power from the drive subsystem to rotate the at least one friction wheel to scuff the surface to be scuffed.

6. The scuffing device of claim 1, wherein the extending/retracting device comprises:

a lead screw driven by the drive subsystem; and a threaded member threaded onto the lead screw, such that, when the lead screw is driven by the drive system in the first and second directions, the threaded member moves along the lead screw toward the extended and retracted positions, respectively, to move the scuffer arm to the extended and retracted positions, respectively.

7. The scuffing device of claim 6, wherein the drive subsystem comprises:

a motor; and a drive transfer system that connects the motor to the lead screw such that rotation of the motor causes the lead screw to rotate.

8. The scuffing device of claim 7, wherein:

the drive transfer system comprises:

a first belt/pulley subsystem, and a second belt/pulley subsystem connected to the first belt/pulley subsystem; and the drive transfer system transmits power from the drive subsystem to drive the threaded member to move the scuffer arm between the engaging position and the disengaging position based on a relative position of the threaded member.

9. The scuffing device of claim 1, wherein:

the engagement control device comprises:

an engagement portion connected to the scuffer arm; and an engaging portion that engages and supports the engagement portion.

10. The scuffing device of claim 9, wherein:

the engaging portion engages the engagement portion to control the angle of orientation of the scuffer arm relative to the surface to be scuffed during the extension or retraction of the scuffer arm.

11. The scuffing device of claim 9, wherein the engagement portion includes a recessed surface.

12. The scuffing device of claim 11, wherein the recessed surface is arched.

13. The scuffing device of claim 9, wherein the engagement portion includes a cam portion.

14. The scuffing device of claim 9, wherein the engaging portion includes a roller bearing.

15. The scuffing device of claim 9, further comprising a support frame that supports the scuffer arm, the extending/retracting device and the engagement control device.

16. The scuffing device of claim 15, wherein the engaging portion is connected to the support frame.

17. A compiling module usable to compile at least one sheet, comprising:

a sheet transport system that transports sheets received from an upstream sheet processing module;

a compiling tray that receives the sheets from the sheet transport system; and the scuffing device of claim 1, wherein the surface to be scuffed is a top sheet in the compiling tray and the scuffing device scuffs the top sheet into a registration position on the compiling tray.

18. An image forming device, comprising the compiling module of claim 17, wherein the image forming device forms an image on a sheet in a sheet processing module that is upstream of the compiling module.

19. A method for scuffing a surface to be scuffed, comprising:

operating a drive subsystem, that is connected to an extending/retracting device, in a first direction;

moving the extending/retracting device from a retracted position to an extended position in response to operating the drive subsystem in the first direction, wherein a scuffer arm is connected to the extending/retracting device;

driving the scuffer arm from a retracted position to an extended position in response to moving the extending/retracting device from the retracted position to the extended position, while supporting an engagement portion of the scuffer arm using a stationary engagement portion to control an orientation of the scuffer arm relative to the surface to be scuffed; wherein, as the scuffer arm moves from the retracted position to the extended position, the scuffer arm engages the surface to be scuffed to scuff the surface to be scuffed in a scuffing direction;

driving at least one friction wheel to scuff the surface to be scuffed;

operating the drive subsystem in a second direction;

moving the extending/retracting device from the extended position to the retracted position in response to operating the drive subsystem in the second direction; and driving the scuffer arm from the extended position to the retracted position in response to moving the extending/retracting device from the extended position to the retracted position.

20. A method for scuffing a sheet into a registration position, comprising:

receiving the sheet from an upstream sheet processing module;

transporting the sheet to a compiling tray using a sheet transport system; and scuffing the sheet using the method of claim 19 with the sheet acting as the surface to be scuffed such that the sheet is scuffed into the registration position on the compiling tray.

* * * * *